United States Patent [19]

Hahn et al.

[11] Patent Number: 4,697,973

[45] Date of Patent: Oct. 6, 1987

[54] APPARATUS AND METHOD FOR HANDLING FOLDED CARTONS

[75] Inventors: Roger A. Hahn, Arvada; Henry H. Heins, Golden, both of Colo.

[73] Assignee: Adolph Coors Company, Golden, Colo.

[21] Appl. No.: 820,063

[22] Filed: Jan. 21, 1986

[51] Int. Cl.[4] ..... B65B 41/06; B65H 3/08

[52] U.S. Cl. ..... 414/330; 414/116; 414/737; 271/31.1; 271/98; 271/107; 271/150

[58] Field of Search ..... 271/31.1, 100, 107, 271/150, 12, 97, 98, 93; 414/330; 493/316; 198/689.1

[56] References Cited

U.S. PATENT DOCUMENTS

| | | | |
|---|---|---|---|
| 2,282,224 | 5/1942 | Harrold | 271/98 |
| 2,289,200 | 7/1942 | Ardell | 493/316 |
| 2,847,213 | 8/1958 | Duncanson et al. | 271/150 |
| 3,783,752 | 1/1974 | Langen et al. | 493/316 |
| 3,827,548 | 8/1974 | Matsuo | 198/689.1 |
| 3,884,278 | 5/1975 | Nakashima | 141/114 |
| 4,273,322 | 6/1981 | Ginther, Sr. et al. | 271/149 |
| 4,375,285 | 3/1983 | Dennhardt | 271/98 |
| 4,394,011 | 7/1983 | Dalton | 271/31.1 |
| 4,480,742 | 11/1984 | Muylle | 198/689.1 |
| 4,518,301 | 5/1985 | Greenwell | 414/129 |
| 4,564,188 | 1/1986 | McNair | 271/103 |
| 4,616,818 | 10/1986 | Vischer | 493/478 |
| 4,629,446 | 12/1986 | Focke | 493/317 |

FOREIGN PATENT DOCUMENTS 0012610 6/1980 European Pat. Off. .

*Primary Examiner*—Frederick R. Schmidt
*Assistant Examiner*—William E. Terrell
*Attorney, Agent, or Firm*—Klaas & Law

[57] ABSTRACT

A system for the transfer of an individual folded carton from a supply of folded cartons to a conveyor for further processing using a vacuum unit that is reciprocated over an arcuate path and wherein vacuum is applied to the vacuum unit immediately prior to its contact with a first one of a supply of folded cartons so as to secure the first one to the vacuum unit and the vacuum is discontinued from the vacuum unit after the vacuum unit and the first one of the folded cartons have moved away from the supply of folded cartons through a distance less than about three inches.

8 Claims, 4 Drawing Figures

APPARATUS AND METHOD FOR HANDLING FOLDED CARTONS

FIELD OF THE INVENTION

This invention relates generally to a system for handling folded cartons wherein an individual folded carton is sequentially removed from a continuous supply of folded cartons and deposited on a conveyor for further processing and particularly to such a system wherein a vacuum assist is provided in the system for a short time during the transfer of an individual folded carton from a supply of folded cartons and its deposition on the conveyor.

BACKGROUND OF THE INVENTION

In a prior art system for removing an individual folded carton from a continuous supply of folded cartons, a knife and a screw are used to separate the individual folded carton and place them on a conveyor. When the folded cartons are relatively large, such as a folded carton for a twenty-four pack of cans, some folded cartons have a tendency to bow or skew causing the knife and screw system to misfeed cartons. In folded carton feed systems operating at rates of about eight cartons per minute, a misfeed that causes an interruption, is a serious problem. Some carton feeders presently on the market use vacuum pick-ups for removing an individual folded carton but such systems have an elevated carton supply system that require a platform for an operator.

BRIEF DESCRIPTION OF THE INVENTION

This invention provides apparatus and method for handling folded cartons wherein a supply of folded cartons is located in a feed station so that a first one of the folded cartons may be contacted by and secured to a vacuum unit while a vacuum is being applied to the vacuum unit. The first one of the folded cartons and the vacuum unit are moved through a relatively short distance to separate the first one of folded cartons from the continuous supply of folded cartons. The application of the vacuum is ceased so that the separated first carton falls away from the vacuum unit and is deposited on a moving conveyor for further processing.

In one embodiment of the invention, a supply of folded cartons is loaded onto a conveyor having means for continuously supplying folded cartons to a feed station so that a first one of the folded cartons is urged against a retaining means. A vacuum unit is connected to means for moving the vacuum unit toward and away from the supply of folded cartons, preferably through an arcuate path. As the vacuum unit moves toward the supply of folded carton, a vacuum is applied to the vacuum unit. The movement of the vacuum unit is continued until it contacts the first one of the folded cartons. The vacuum in the vacuum unit securely holds the first one of the folded cartons to the vacuum unit. The vacuum unit with the first one of the folded cartons is then moved away from the supply of folded cartons and overcomes the restraining means so as to separate the first one of the folded cartons from the supply of folded cartons. Means are provided to ensure that the folded carton next to the first one of the folded cartons does not move therewith. After the vacuum unit and the separated first one of the folded cartons has moved through a relatively short distance, such as a distance less than about three inches, the application of the vacuum to the vacuum unit is discontinued and the separated first one of the folded cartons falls away from the vacuum unit. Means are provided to attract the separated first one of the folded cartons onto a moving conveyor for further processing. Means are provided to move the supply of folded cartons when necessary so that another first one of the folded cartons is always against the retaining means.

It is an object of this invention to provide apparatus and method using a vacuum assist in separating a folded carton from a supply of folded cartons and depositing the separated folded carton on a conveyor for further processing.

It is another object of this invention to provide apparatus for moving a vacuum unit toward and away from a supply of folded cartons in a controllable time sequence.

Additional objects, advantages and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figures 1, 4:
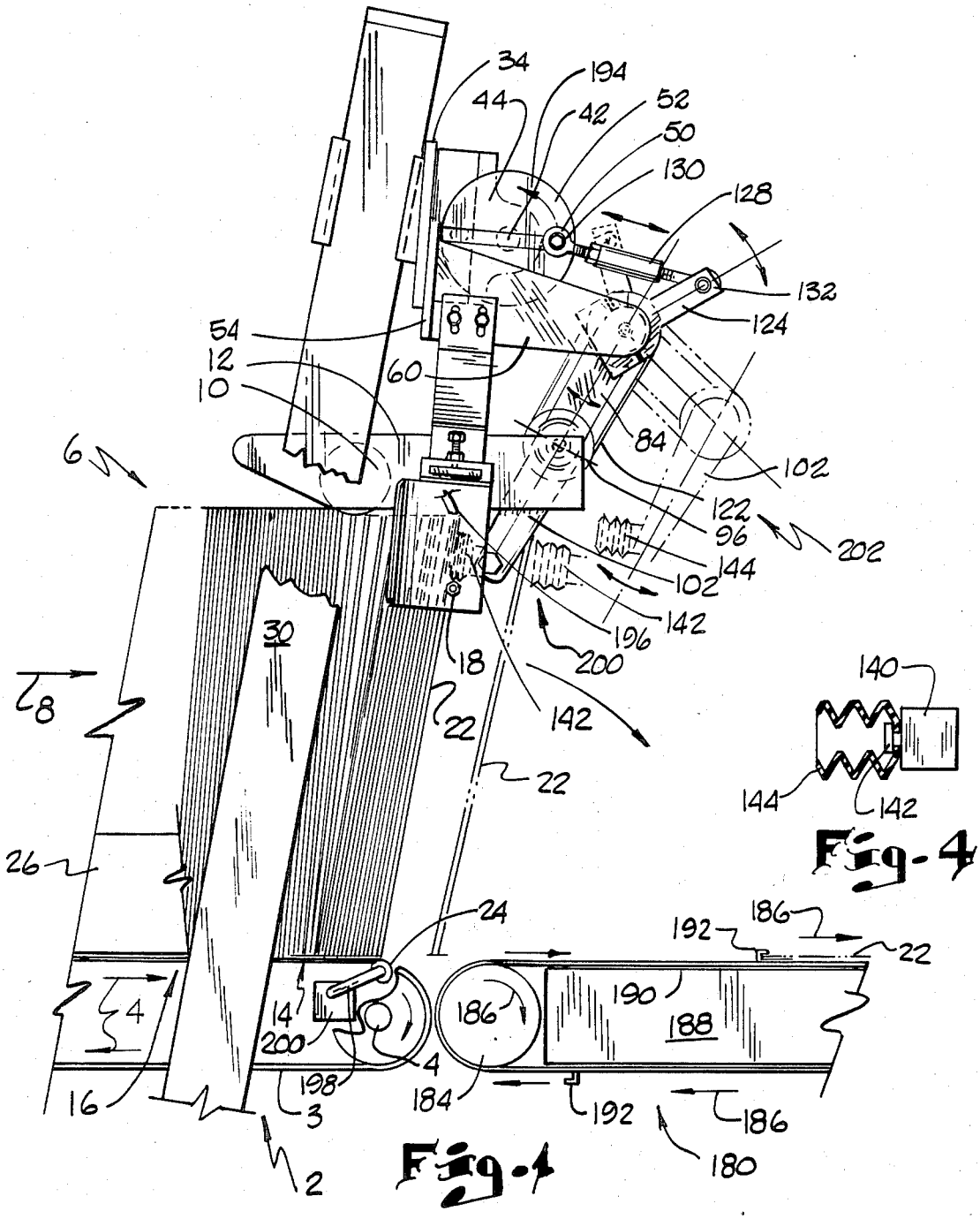
FIG. 1 is a side elevational view of one embodiment of the invention.
FIG. 4 is an enlarged view of a portion of the vacuum unit and illustrating the attachment of a vacuum cup.
Figure 2:
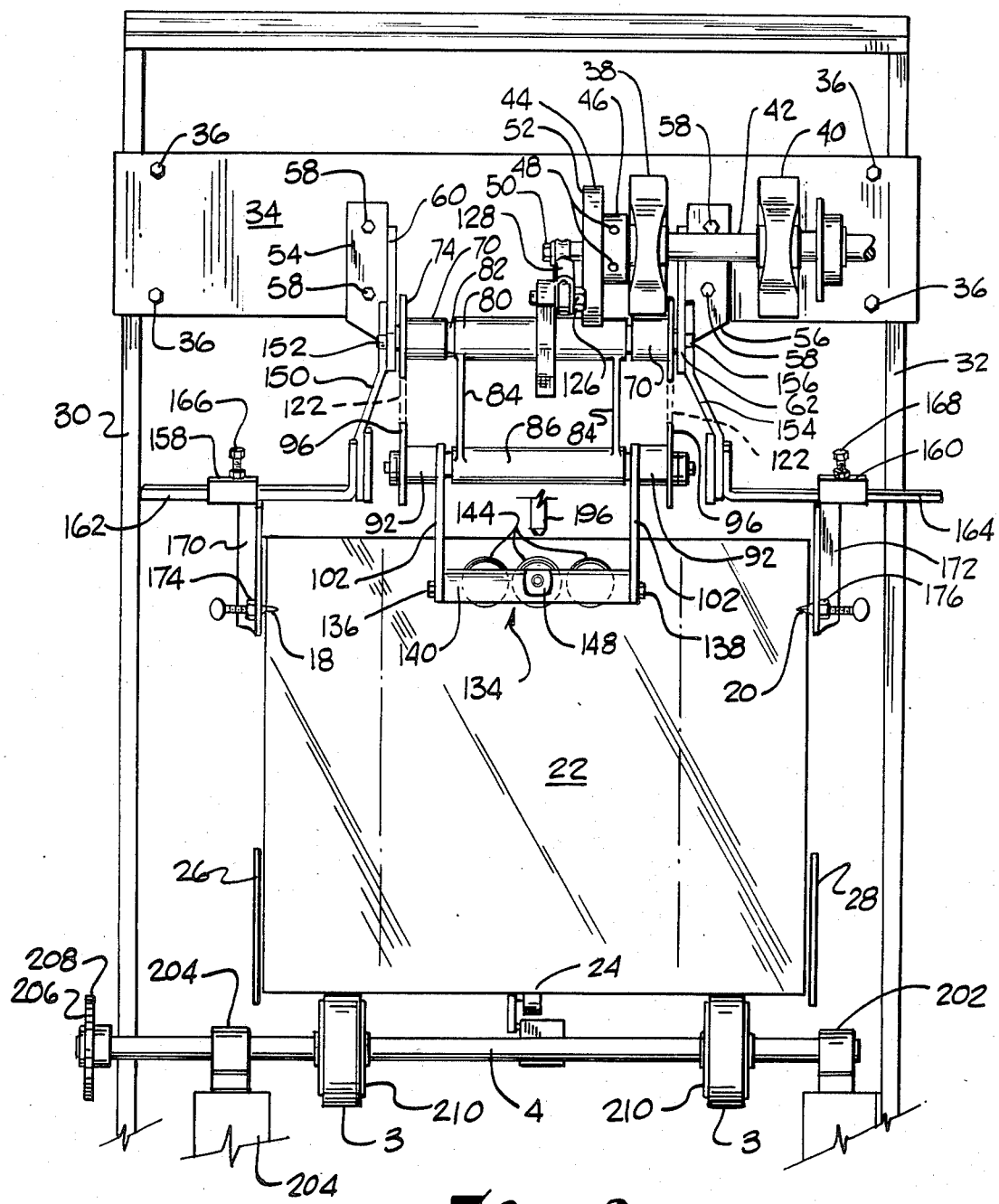
FIG. 2 is a front elevational view of the embodiment of FIG. 1.

One embodiment of the invention is illustrated in FIGS. 1 and 2 and comprises an endless conveyor 2 comprising spaced apart belts 3 having suitable means, described velow, to rotate the mandrel 4 to move the conveyor 2 in the direction indicated by the arrows 5. A continuous supply 6 of folded cartons is positioned on the conveyor 2 and suitable means (not shown) are provided to apply a force 8 on the folded cartons in a direction indicated by the arrow. A roller 10 mounted on the lever 12 is urged into contact with the tops of the cartons to relieve the effect of the force 8 so that the force on the tops of the cartons 14 is less than the force on the tops of the cartons 16. The movement of the conveyor 2 and the effect of the force 8 moves the folded cartons 14 into a feed station having a retaining means 18 and 20 positioned to contact a first one 22 of the supply 6 of folded cartons at upper portions thereof. A micro-switch 24 is positioned to cooperate with the bottom portion of the supply 6 of folded cartons to control the movement of the conveyor 2 in an intermittent manner as described below. The retaining means 18 and 20 lie in a vertical plane spaced from the vertical plane of the micro-switch 24 which acts to provide a retaining force on the bottom of the folded cartons so that the first one 22 of the supply 6 of folded cartons lies in a vertical plane extending at an angle of between about 75 degrees to 85 degrees and preferably about 80 degrees to the horizontal. Guide means 26 and 28 are used to center the supply 6 of folded cartons on the conveyor and are adjustable so as to accommodate folded cartons of varying sizes.

The mechanism used to transfer the folded cartons comprises a pair of spaced apart frame members 30 and 32 fixedly mounted on each side of the conveyor 2. A support member 34 is slidably mounted on the frame members 30 and 32 and is provided with means 36 for holding it at a desired location on the frame members 30 and 32. This permits adjustment to accommodate folded cartons of varying sizes.

A pair of spaced apart pillow block bearings 38 and 40 are mounted on the support member 34. A shaft 42 is mounted for rotation in the pillow block bearings 38 and 40 and the shaft 42 is rotated by conventional means (not shonw). A hub 44 having a collar 46 is secured to the end of the shaft 42 for rotation therewith by suitable means, such as the set screws 48. A post 50 extends outwardly from a surface 52 of the hub 44.

A pair of spaced apart support plates 54 and 56 are secured to the support member 34 by suitable means, such as the bolts 58. Support arms 60 and 62, each of which is integral with one of the support plates 54 and 56, extend outwardly therefrom.

Figure 3:
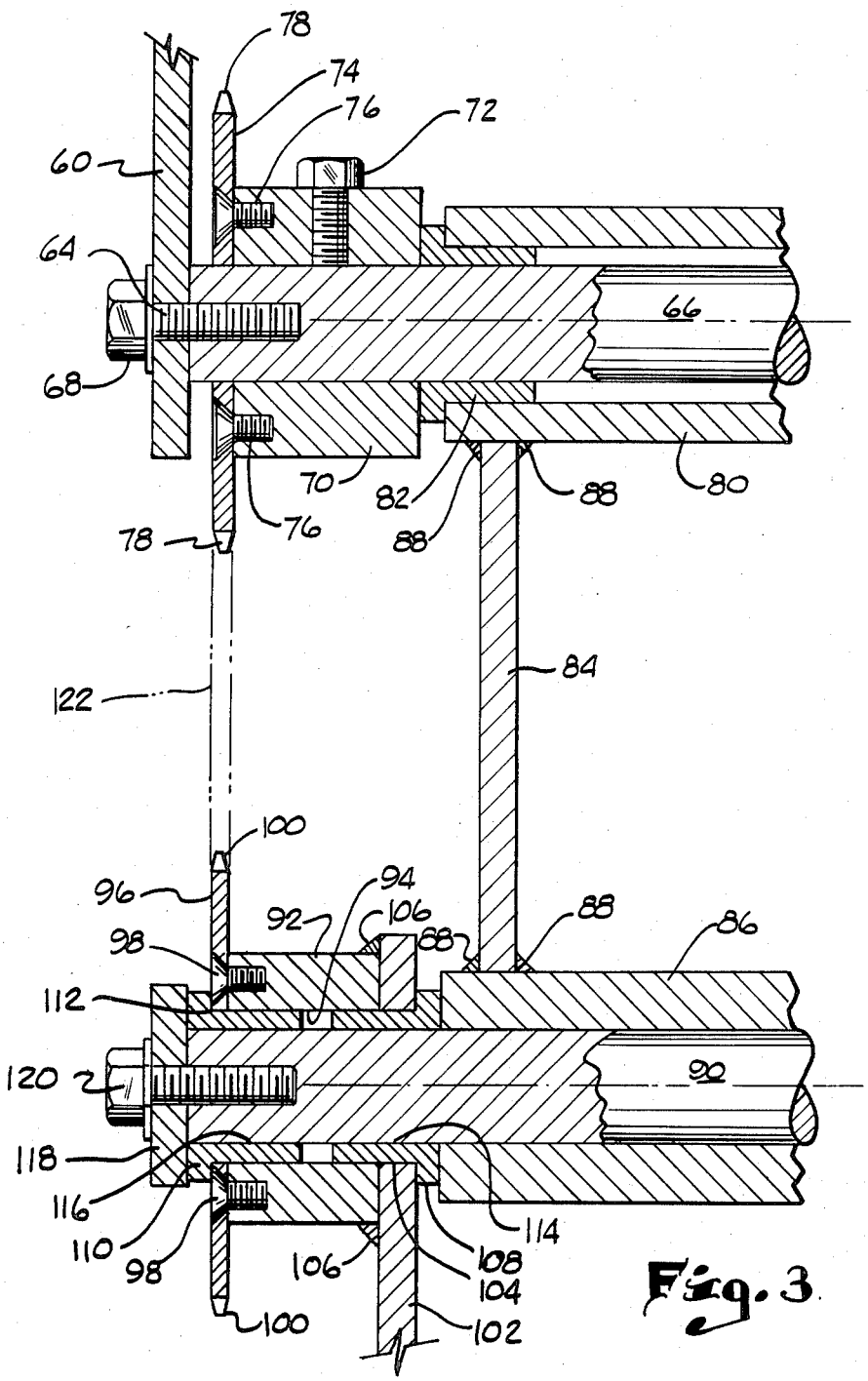
FIG. 3 is an enlarged view with parts in section of a portion of one side of the mechanisms for moving the vacuum unit of this embodiment of the invention.

In FIG. 3, therein is illustrated one side of the mechanisms for moving the vacuum unit of this embodiment of the invention as explained more fully below. Only the mechanisms supported by the support arm 60 will be explained below but it is understood that the mechanisms supported by the support arm 62 are exact duplicates. An opening 64 is provided in the support arm 60 and one end of a shaft 66 is fixedly secured to the support arm 60 by a bolt 68 passing through the opening 64 and threadedly secured to the shaft 66. A block 70 is slidably mounted on the shaft 66 and is provided with suitable means, such as a set screw 72, for holding it in a desired position on the shaft 66. A sprocket 74 is fixedly secured to the block 70 for movement therewith by suitable means, such as the bolts 76. The sprocket 74 has a plurality of teeth 78 around its periphery. A hollow sleeve 80 is mounted for rotation around the shaft 66 by a bearing 82.

A bar 84 has one end thereof secured to the hollow sleeve 80 and the other end thereof secured to a hollow sleeve 86 by suitable means, such as by welding 88. A shaft 90 is fixedly secured to the hollow sleeve 86. A block 92 having a central bore 94 has a sprocket 96 fixedly secured thereto by suitable means, such as bolts 98. The sprocket 96 has a plurality of teeth 100 around its periphery. An arm 102 having an opening 104 is secured to the other end of the block 92 by suitable means, such as by welding 106, so that the bore 94 and opening 104 are in alignment. A bearing 108 is inserted into one end of the block 92 and positioned in the openings 94 and 104 and another bearing 110 is inserted into the other end of the block 92 and positioned in the bore 94 and an aligned opening 112 in the sprocket 96. The end of the shaft 90 is then inserted into the central bores 114 and 116 of the bearings 108 and 110. A washer 118 is held on the end of the shaft 90 by a threaded bolt 120 so that the bearings 108 and 110 are held in position by the bearing 108 in abutting relationship with the end of the hollow shaft 86 and the bearing 110 in abutting relationship with the washer 118. Thus, the arm 102 is rotatably mounted on the shaft 90. A chain 122 is journaled around sprockets 74 and 96 and is provided with suitable openings through which the teeth 78 and 100 pass.

A pivot arm 124 is fixedly mounted on the outer surface of the hollow sleeve 80. A post 126 extends outwardly from the pivot arm 124. A turnbuckle 128 extends between the post 50 and the post 126. A bearing 130 is mounted in one end of the turnbuckle 128 and positioned on the post 54. A bearing 132 is mounted in the other end of the turnbuckle 128 and is positioned on the post 126. This structure provides movement of the pivot arm 124 in one direction during one half of a revolution of the hub 44 and movement in the opposite direction during the other second half of the revolution.

A vacuum unit 134 is positioned between the ends of the arms 102 and is secured thereto by bolts 136 and 138. The vacuum unit 134 comprises a vacuum body 140 having a plurality of hollow projections 142 thereon, preferably as illustrated in FIG. 3 as three in number, and over which are positioned vacuum cups 144. Each of the vacuum cups comprises a flexible, corrugated boot formed from rubber or other similar material. A vacuum transducer 148 is used to form a vacuum in the vacuum body 140 and therefore a vacuum in the vacuum cups 144 when desired. The vacuum transducer 148 is a standard unit and functions in its conventional way to produce the vacuum when desired and to discontinue the vacuum when desired.

A bracket 150 is mounted on the support arm 60 by suitable means such as bolts 152 and a bracket 154 is mounted on the support arm 62 by suitable means such as bolts 156. Slides 158 and 160 are mounted respectively for movement over arms 162 and 164 of the brackets 150 and 154 and are provided with locking means 166 and 168 for holding the slides 158 and 160 at desired locations. Support angles 170 and 172 depend from slides 158 and 160 and are provided with threaded bosses 174 and 176. The retaining means 18 is threadedly mounted in boss 174 and the retaining means 20 is threadedly mounted in boss 176 so that the retaining means 18 and 20 may be adjusted to change the amount of surface contact on the first one 22 of the folded cartons. Also, the slides 158 and 160 may be adjusted to provide for folded cartons of varying sizes.

An endless conveyor 180 is located next to the conveyor 2. Suitable rollers 182 and 184 locate the conveyors 2 and 180 so that there is a minimum of space therebetween. Suitable means (not shown) are used to move the conveyor 180 in the direction indicated by the arrows 186. A vacuum box 188 is mounted between the reaches of the conveyor 180 and applied a vacuum under the upper reach 190. Aligned pairs of lugs 192 are attached to the conveyor 180 at spaced apart locations and function to align the separated first one 22 of the folded cartons on the conveyor 180.

The operation of the apparatus, particularly as illustrated in FIG. 1, is as follows. A supply 6 of folded cartons is loaded onto the conveyor 2 which is moved until the first one 22 of the folded cartons is against the retaining means 18, 20. As stated above, the roller 10 has taken off some of the force 8 from the tops of the folded cartons 14. The suction cups 144 are in contact with surface of the first one 22 of the folded cartons at a location adjacent to but spaced from the top edge of the first one 22 of the folded cartons. Vacuum is being appled to the vacuum cups 144 by the vacuum transducer 148. The combination of the vacuum and the force exerted by the arms 102 has collapsed the corrugations of the rubber boots of the vacuum cups 144. The hub 44 is being rotated in the direction indicated by the arrow 194 so that the pivot arm 124 is in position to start moving toward the hub 44. As the pivot arm 124 moves toward the hub 44, it rotates the hollow sleeve 80 around the shaft 66 and also rotates the bars 84 around the shaft 66. As the bars 84 rotate, the chain 122 and the sprockets 74 and 96 cause the arms 102 to rotate around the shaft 90. As viewed in FIG. 1, when the pivot arm 124 and the bars 84 rotate in a clockwise direction, the arms 102 rotate in a counter clockwise direction and vice versa. The chain 122 and the sprockets 74 and 96 are so dimensioned that the arms 102 move through the same number of degrees as the pivot arm 124 and the bars 84 but in the opposite direction. The continued movement of the hub 44 as illustrated in FIG. 1 results in moving the vacuum unit 134 in a direction away from the supply 6 of folded cartons. Since the first one 22 of the folded cartons is secured to the vacuum unit 134 by the vacuum cups 144, it moves with the vacuum unit 134. As the first one 22 of folded cartons moves with the vacuum unit 134, it flexes an amount sufficient for it to pass between the retaining means 18 and 20 and to be pulled over the retaining means 24. An air nozzle 196 is secured by suitable means (not shown) and is located to direct air onto the back side of the first one 22 of the folded cartons as it is being separated and to prevent the next one of the folded cartons from moving with the first one 22 of the folded cartons.

Micro-switch 24 is connected to an arm 198 which is a control unit 200 and is urged in a direction of the supply 6 of folded cartons by suitable means in the unit so as to place a restraining force thereon. In the down position as illustrated in FIG. 1, the conveyor 2 is not moving. After a plurality, such as 2 to 5, of the first ones 22 of the folded cartons have been transferred, the micro-switch 24 pivots upwardly until it is in front of the next first one of the folded cartons. As the micro-switch 24 moves upwardly, it activates suitable means in the control unit 200 so that the conveyor 2 is moved so as to position more folded cartons into the supply of folded cartons. Thus, the conveyor 2 operates in an intermittent manner to maintain a continuous supply of folded cartons. The mandrel 4 is mounted for rotation in journal boxes 202 secured to fixed supports 204. A sprocket 206 is secured to one end of the mandrel 4 and is rotated by a chain 208 driven by suitable means (not shown). Pulleys 210 mounted on the mandrel 4 receive the conveyor belts 3 and rotate with the mandrel 4 so as to drive the conveyor belts 3 in the direction indicated by the arrows 5.

When the vacuum unit 134 has moved through a distance less than about three inches, preferably about one and one-half inches, the vacuum transducer 148 discontinues the application of the vacuum to the vacuum cups 144. The corrugations of the boots return to an open position and the separated first one 22 of the folded cartons is disengaged from the vacuum cups 144. This disengagement occurs just prior to the position 200 illustrated in FIG. 1. The vacuum unit 134 continues to move in an arcuate path until it reaches the position 202 illustrated in FIG. 1. As illustrated in FIG. 1, the surfaces of the vacuum cups 144 move in parallel planes so that they always contact the first one 22 of the folded cartons in the correct position.

After the separated first one 22 of the folded cartons has been disengaged, the movement imparted to the first one 22 of the folded cartons by the movement of the vacuum unit 132, air from the nozzle 196 and the vacuum from the vacuum box 188 cooperate to deposit it onto the conveyor 180. The vacuum box 188 holds the separated first one 22 of the folded cartons in a fixed location until the bottom edge thereof is contacted by a pair of lugs 192 to move with the conveyor 180.

After the vacuum unit 134 has reached the position 202, continued rotation of the hub 44 starts movement of the pivot arm 124 in direction away from the hub 44. This causes movement of the vacuum unit 134 toward the another first one 22 of the folded cartons until the vacuum cups 144 are in the comprssed condition illustrated in FIG. 1 with vacuum being applied by the vacuum transducer. The transducer 148 applies the vacuum immediately before the vacuum cups 144 contact the first one 22 of the folded cartons. The apparatus is normally operated at rates to transfer about eighty folded cartons per minute from the supply 6 of folded cartons onto the conveyor 180.

It is contemplated that the inventive concepts herein described may be variously otherwise embodied and it is intended that the appended claims be construed to include alternative embodiments of the invention except insofar as limited by the prior art.

What is claimed is:

1. Apparatus for handling folded cartons comprising:

conveyor means having an upper portion extending between a first end portion and a second end portion;

mounting means for holding a plurality of folded cartons having lower, upper and opposite side edges and front and rear surfaces on said upper portion with said lower edge of each folded carton in contact with said upper portion and with said front and rear surfaces of adjacent folded cartons in an abutting contacting relationship;

moving means for moving said folded cartons in one direction from said first end portion toward said second end portion;

retaining means for releasably retaining a first one of said folded cartons at a desired location so that said first one has an exposed front surface;

a processing conveyor means having an upper portion and an end portion adjacent to but spaced from said second end portion;

moving means for continuously moving said upper portion of said processing conveyor means;

a vacuum unit having at least one device having a surface for contacting said exposed front surface of said first one;

moving means for moving said vacuum unit toward said folded cartons and into contact with said exposed surface of said first one and for moving said vacuum unit and said first one away from the remaining folded cartons;

vacuum forming means for forming a vacuum in said vacuum unit when said vacuum unit is in contact with said exposed front surface of said first one so that said first one will move with said vacuum unit as said vacuum unit moves away from said folded cartons and to discontinue said vacuum in said vacuum unit after said first one has been separated from said remaining folded cartons;

force applying means for imparting movement to said first one, after said vacuum has been discontinued, in a direction so that said separated first one is deposited on said upper portion of said processing conveyor means;

said movement of said vacuum unit toward and away from said folded cartons is through an arcuate path;

said means for moving said vacuum unit comprises a parallel motion mechanism;

means for moving said parallel motion mechanism in either a clockwise or counter-clockwise direction;

said parallel motion mechanism and said means for moving said parallel motion mechanism in either a clockwise or counter-clockwise direction comprises:

a rotor mounted for rotation about a fixed axis;

means for rotating said rotor;

a lever having one free end and means mounting the other end of said lever for rotation about a fixed shaft;

a rod rotatably mounted at one end to said free end of said lever and at the other end to said rotor so that said rod moves said lever in a clockwise direction during rotation of said rotor through one-half of a revolution and in a counter-clockwise direction through the other half of said revolution;

an arm secured at one end to said means mounting said lever for rotation with said lever and at its other end fixed to a shaft for movement with said arm;

support means connected at one end to said vacuum unit and at its other end rotatably mounted on said shaft of said arm; and means for rotating said support means through the same number of degrees that said arm and said lever are rotated but in an opposite direction.

2. Apparatus as in claim 1 and further comprising:

said vacuum unit is located on said support means so as to contact the central portion of said exposed front surface of said first one adjacent to but spaced from the upper edge thereof.

3. Apparatus as in claim 2 wherein said retaining means comprises:

means for contacting at least a portion of the upper half of said exposed front surface of said first one; and means for contacting at least a portion of the lower edge of said first one.

4. Apparatus as in claim 2 and further comprising:

vacuum means associated with said processing conveyor means to pull said separated first one toward said processing conveyor means.

5. Apparatus as in claim 4 wherein said means for contacting at least a portion of the upper half of said exposed front surface of said first one comprises:

at least one threaded screw having a tapered end;

means having cooperating threads for mounting said at least one threaded screw so that a portion of said tapered end contacts said exposed front surface of said first one; and means for rotating said at least one threaded screw to vary the amount of contact between said tapered end and said exposed front surface of said first one.

6. Apparatus as in claim 5 and further comprising:

means for mounting at least two threaded screws so that a portion of one threaded screw may be positioned to contact one side of said exposed front surface of said first one and a portion of the other threaded screw may be positioned to contact the other side of said exposed front surface of said first one.

7. Apparatus as in claim 6 and further comprising:

means for mounting said means for mounting at least two threaded screws so that said at least two threaded screws may be moved relative to each other to vary the distance therebetween so as to accommodate different sizes of folded cartons.

8. Apparatus as in claim 1 wherein:

said moving means for moving said folded cartons in one direction operates in an intermittent manner.

* * * * *